US006159098A

United States Patent [19]

Slomiany et al.

[11] Patent Number: 6,159,098

[45] Date of Patent: Dec. 12, 2000

[54] DUAL-AWARD BONUS GAME FOR A GAMING MACHINE

[75] Inventors: Scott Slomiany, Streamwood; William A. Grupp, Sleepy Hollow, both of Ill.

[73] Assignee: WMS Gaming Inc., Chicago, Ill.

[21] Appl. No.: 09/145,505

[22] Filed: Sep. 2, 1998

[51] Int. Cl.[7] ..... A63F 9/22; A63F 3/06

[52] U.S. Cl. ..... 463/25; 463/16; 463/20; 273/139

[58] Field of Search ..... 463/1, 9, 10, 16–20, 463/25, 26–28, 30; 273/138.1, 138.2, 139, 143 R, 292–293

[56] References Cited

U.S. PATENT DOCUMENTS

| | | | |
|---|---|---|---|
| 3,281,149 | 10/1966 | Miller . | |
| 4,095,795 | 6/1978 | Saxton et al. . | |
| 4,306,768 | 12/1981 | Egging . | |
| 4,335,809 | 6/1982 | Wain . | |
| 4,448,419 | 5/1984 | Telnaes . | |
| 4,508,345 | 4/1985 | Okada | 273/143 R |
| 4,624,459 | 11/1986 | Kaufman | 273/143 R |
| 4,721,307 | 1/1988 | Okada . | |
| 4,763,256 | 8/1988 | DeMar . | |
| 4,772,023 | 9/1988 | Okada | 273/143 R |
| 4,805,907 | 2/1989 | Hagiwara . | |
| 4,871,171 | 10/1989 | Rivero . | |
| 5,083,785 | 1/1992 | Okada | 273/143 R |
| 5,169,147 | 12/1992 | Hamano | 273/138 A |
| 5,205,555 | 4/1993 | Hamano . | |

(List continued on next page.)

FOREIGN PATENT DOCUMENTS

| | | |
|---|---|---|
| 0 148 001 | 7/1985 | European Pat. Off. . |
| 0 333 338 | 9/1989 | European Pat. Off. . |
| 0 577 415 A2 | 1/1994 | European Pat. Off. . |
| 0 142 371 | 6/1995 | European Pat. Off. . |
| 1 474 617 | 4/1966 | France . |
| 37 00 861 | 7/1988 | Germany . |
| 40 14 477 | 7/1991 | Germany . |
| 1129607 | 10/1968 | United Kingdom . |
| 1 476 848 | 6/1977 | United Kingdom . |
| 1 591 623 | 6/1981 | United Kingdom . |

(List continued on next page.)

OTHER PUBLICATIONS

Williams Electronics Games, Inc., Phantom House, all pages, Jul. 1996.

Chapters 10, 11, 12; excerpts from "Lemons, Cherries and Bell–Fruit–Gum"; Richard M. Bueschel; 71 pgs.; 1995.

Advertisement, Club Vegas Barcrest; 1 pg.; date unknown.

Advertisement, Viva Club Vegas!, Barcrest; 1 pg.; date unknown.

Advertisement, "Monopoly: Maygay There for the Taking"; 2 pgs.; date unknown.

Advertisement, "The Big Breakfast"; Channel Four Television Corporation; 2 pgs.; 1993.

Advertisement, "Midas Touch"; 2 pgs.; date unknown.

(List continued on next page.)

*Primary Examiner*—Michael O'Neill
*Assistant Examiner*—John M. Hotaling
*Attorney, Agent, or Firm*—Jenkens & Gilchrist

[57] ABSTRACT

A bonus game for a gaming machine with two types of awards. The bonus game includes a plurality of selection elements, a number of which are associated with an award of coin(s) or credit(s) and a number of which are associated with an end-bonus penalty. The game is played by selecting a number of the selection elements, one at a time, until encountering a selection element associated with an end-bonus penalty which ends the bonus game. A first award type in the bonus game is a selection-based award in which the player is credited an amount of coin(s) or credit(s) based on the value (or cumulative value) of the selection elements selected in the bonus game. A second award type in the bonus game is a quantity-based award in which the player is credited an amount of coin(s) or credit(s) based on the number of successful trials of the bonus game.

21 Claims, 8 Drawing Sheets

U.S. PATENT DOCUMENTS

| | | | |
|---|---|---|---|
| 5,259,616 | 11/1993 | Bergmann | 273/138 A |
| 5,292,127 | 3/1994 | Kelly et al. . | |
| 5,342,047 | 8/1994 | Heidel et al. | 273/85 CP |
| 5,342,049 | 8/1994 | Wichinsky et al. . | |
| 5,380,008 | 1/1995 | Mathis et al. | 273/143 R |
| 5,393,057 | 2/1995 | Marnell, II | 273/85 CP |
| 5,401,024 | 3/1995 | Simunek | 273/138 A |
| 5,415,404 | 5/1995 | Joshi et al. | 273/138 A |
| 5,429,361 | 7/1995 | Raven et al. . | |
| 5,449,173 | 9/1995 | Thomas et al. . | |
| 5,456,465 | 10/1995 | Durham | 273/138 A |
| 5,542,669 | 8/1996 | Charron et al. . | |
| 5,547,192 | 8/1996 | Ishibashi | 463/26 |
| 5,624,119 | 4/1997 | Leake . | |
| 5,647,798 | 7/1997 | Falciglia . | |
| 5,664,781 | 9/1997 | Feola | 273/292 |
| 5,697,843 | 12/1997 | Manship et al. | 463/20 |
| 5,704,835 | 1/1998 | Dietz, II . | |
| 5,722,891 | 3/1998 | Inoue | 463/20 |
| 5,779,545 | 7/1998 | Berg et al. | 463/22 |
| 5,788,573 | 8/1998 | Baerlocher et al. | 463/16 |
| 5,823,874 | 10/1998 | Adams | 463/17 |
| 5,848,932 | 12/1998 | Adams . | |
| 5,931,467 | 8/1999 | Kamille | 273/139 |
| 5,951,397 | 9/1999 | Dickinson | 463/36 |
| 6,015,346 | 1/2000 | Bennett | 463/20 |
| 6,089,976 | 8/1999 | Schneider et al. | 463/16 |

FOREIGN PATENT DOCUMENTS

| | | |
|---|---|---|
| 2 066 991 | 7/1981 | United Kingdom . |
| 2 083 936 | 3/1982 | United Kingdom . |
| 2 084 371 | 4/1982 | United Kingdom . |
| 2 096 376 | 10/1982 | United Kingdom . |
| 2 097 160 | 10/1982 | United Kingdom . |
| 2 105 891 | 3/1983 | United Kingdom . |
| 2 106 685 | 10/1983 | United Kingdom . |
| 2 117 952 | 10/1983 | United Kingdom . |
| 2 072 395 | 5/1984 | United Kingdom . |
| 2 147 442 | 5/1985 | United Kingdom . |
| 2 147 773 | 5/1985 | United Kingdom . |
| 2 152 262 | 7/1985 | United Kingdom . |
| 2 153 572 | 8/1985 | United Kingdom . |
| 2 157 047 | 10/1985 | United Kingdom . |
| 2 165 385 | 4/1986 | United Kingdom . |
| 2 170 636A | 8/1986 | United Kingdom . |
| 2 180 087 | 3/1987 | United Kingdom . |
| 2 181 589 | 4/1987 | United Kingdom . |
| 2 183 882 | 6/1987 | United Kingdom . |
| 2 191 030 | 12/1987 | United Kingdom . |
| 2 197 974 | 6/1988 | United Kingdom . |
| 2 202 984 | 10/1988 | United Kingdom . |
| 2 204 436 | 11/1988 | United Kingdom . |
| 2 210 191 | 6/1989 | United Kingdom . |
| 2 222 712 | 3/1990 | United Kingdom . |
| 2 226 907 | 7/1990 | United Kingdom . |
| 2 229 565 | 9/1990 | United Kingdom . |
| 2 230 373 | 10/1990 | United Kingdom . |
| 2 233 806 | 1/1991 | United Kingdom . |
| 2 242 300 | 9/1991 | United Kingdom . |
| 2 253 154 | 9/1992 | United Kingdom . |
| 2 262 642 | 6/1993 | United Kingdom . |
| 2 270 787 | 3/1994 | United Kingdom . |
| 2 273 384 | 8/1994 | United Kingdom . |
| 2 287 567 | 9/1995 | United Kingdom . |
| 2 297 857 | 8/1996 | United Kingdom . |
| 2 298 508 | 9/1996 | United Kingdom . |
| WO 8808179 | 10/1988 | WIPO . |
| WO 8912875 | 12/1989 | WIPO . |
| WO 9210818 | 6/1992 | WIPO . |
| WO 9401840 | 1/1994 | WIPO . |

OTHER PUBLICATIONS

Advertisement, "Acropolis"; Automatic (Fruit) Designs, Ltd.; 2 pgs.; date unknown.

Advertisement, "Adders & Ladders"; Barcrest; 2 pgs.; date unknown.

Advertisement, "The Wild West"; Bell–Fruit Manufacturing; 2 pgs.; date unknown.

Advertisement, "Premier Club Manager"; Bell–Fruit Manufacturing; 2 pgs.; date unknown.

Advertisement, "Fortune Wheel"; Project Customer Services; 2 pgs.; date unknown.

Advertisement, "Road Hog"; Barcrest; 2 pgs.; date unknown.

Advertisement, "Viva! Six! Las Vegas"; Barcrest; 2 pgs.; date unknown.

Advertisement, "Golden Circle"; Delta Automaten; 1 pg.; date unknown.

Advertisement, "Club Double"; M–D–M Coin Sales Ltd.; 2 pgs.; date unknown.

Advertisement, "Treasure Island"; American Alpha, Inc.; 1 pg.; date unknown.

Advertisement, "Bonus Card"; Andries Robert Automatic s.p.r.l.; 1 pg.; date unknown.

Advertisement, "Super Square"; Maygay Machines Ltd.; 2 pgs.; date unknown.

Advertisement, "Lucky Bank"; 1 pg.; date unknown.

Advertisement, "Happy Clown"; Andries Robert Automatic s.p.r.l.; 1 pg.; date unknown.

Advertisement, "Jackpot Stampede"; WMS Gaming Inc.; 2 pgs.; date unknown.

Brochure, "Perfect Universal Slot Machines"; Universal Co., Ltd.; 16 pgs.; date unknown.

Advertisement, "Club Make a Million"; Bell–Fruit Manufacturing Co., Ltd.; 2 pgs.; date unknown.

Advertisement, "Instant Jackpots"; Bell–Fruit Manufacturing Co., Ltd.; 2 pgs.; date unknown.

Cover page, "Enter Disposable Gaming"; *Euroslot. The International Coin–Operated Machine Journal*; 1 pg.; Apr., 1994.

Advertisement, Barcrest Limited; 1 pg.; date unknown.

Cover page, "Covers Your World"; *Euroslot. The Currency of the Coin Machine Industry*; 1 pg.; date unknown.

Article, "Bangkok on the Brink"; *Euroslot. The International Coin–Operated Machine Journal*; 2 pgs.; Nov., 1993.

Article, "Scandinavia on the Brink of the EU melting pot"; *Euroslot. The International Coin–Operated Machine Journal*; 2 pgs.; Aug., 1994.

Advertisement, "Only Fools and Horses"; Bell–Fruit Manufacturing Co., Ltd.; 2 pgs.; date unknown.

Advertisement, "Main Attraction"; Bell–Fruit Manufacturing Co., Ltd., 2 pgs.; date unknown.

Brochure, "World Players"; Barcrest; 6 pgs.; date unknown.

Brochure, "JPM Presents Monopoly Deluxe"; JPM International Ltd.; 5 pgs.; date unknown.

Brochure, "The 50th Show"; ATE International; 2 pgs.; Jan., 1994.

Advertisement, "Colossus"; AFD.; 1 pg.; date unknown.

Advertisement, "Wheel of Fortune"; Project Creating Entertainment; 2 pgs.; date unknown.

Advertisement, "Lucky Horseshoes"; JPM Automatic Machines Ltd.; 2 pgs.; date unknown.

Advertisement, "Lucky Jackpots"; JPM Automatic Machines Ltd.; 2 pgs.; date unknown.

Advertisement, "Monopoly"; JPM Automatic Machines Ltd.; 2 pgs.; date unknown.
Brochure of Monopoly SWP Game; JPM Ltd.; 4 pgs.; date unknown.
WMS' Big Money Advertisement Sheet; WMS Gaming Inc.; 1 pg.; date unknown.
WMS' Piggy Bankin Advertisement Sheet; WMS Gaming Inc.; 1 pg.; date unknown.
WMS' Pirate's Thunder Advertisement Sheet; WMS Gaming Inc.; 1 pg.; date unknown.
Bally Circus Ad, excerpt from "Lemons, Cherries and Bell Fruit Gum"; Richard M. Bueschel; 2 pgs.; date unknown.
Bally BingoAd, excerpt from "Lemons, Cherries and Bell Fruit Gum"; Richard M. Bueschel; 2 pgs.; date unknown.
Las Vegas Slot Machine Ad, excerpt from "Lemons, Cherries and Bell Fruit Gum"; Richard M. Bueschel; 2 pgs.; date unknown.
Phantom Haus website publication; Williams Electronics Games, Inc.; 2 pgs.; date unknown.
Arabian Riches website publication; Silicon Gaming Inc.; 2 pgs; date Jul. 17, 1998.
Buccaneer Gold website publication; Silicon Gaming Inc.; 2 pgs; date Jul. 17, 1998.
Fort Knox website publication; Silicon Gaming Inc.; 2 pgs; date Jul. 17, 1998.
Lady of Fortune website publication; Silicon Gaming Inc.; 2 pgs; date Jul. 17, 1998.
Riddle of the Sphinx website publication; Silicon Gaming Inc.; 2 pgs; date Jul. 17, 1998.
Information Sheets for Kaleidoscope game; Williams Electronics Games, Inc.; 3 pgs; date unknown.
Information Sheets for Double Wild & Loose Game; Williams Electronics Games, Inc.; 3 pgs; date unknown.
Information Sheets for Wild Cherry (120A) Game; International Game Technology.; 2 pgs; date Nov. 7, 1994.
Information Sheets for Double Wild Cherry (195A) Game; International Game Technology.; 3 pgs; date Nov. 7, 1994.

| | | | 1 COIN | 2 COIN |
|---|---|---|---|---|
| 7 | WILD | 7 | 400 | 1000 |
| 7 BAR | 7 BAR | 7 BAR | 70 | 140 |
| 7 ANY | 7 ANY | 7 ANY | 50 | 100 |
| BAR BAR BAR | BAR BAR BAR | BAR BAR BAR | 40 | 80 |
| BAR BAR | BAR BAR | BAR BAR | 20 | 40 |
| BAR | BAR | BAR | 10 | 20 |
| ANY BAR | ANY BAR | ANY BAR | 5 | 10 |
| | WILD | | 5 | 10 |
| | | | 2 | 4 |
| | WILD | | 1 | 2 |

Fig. 5
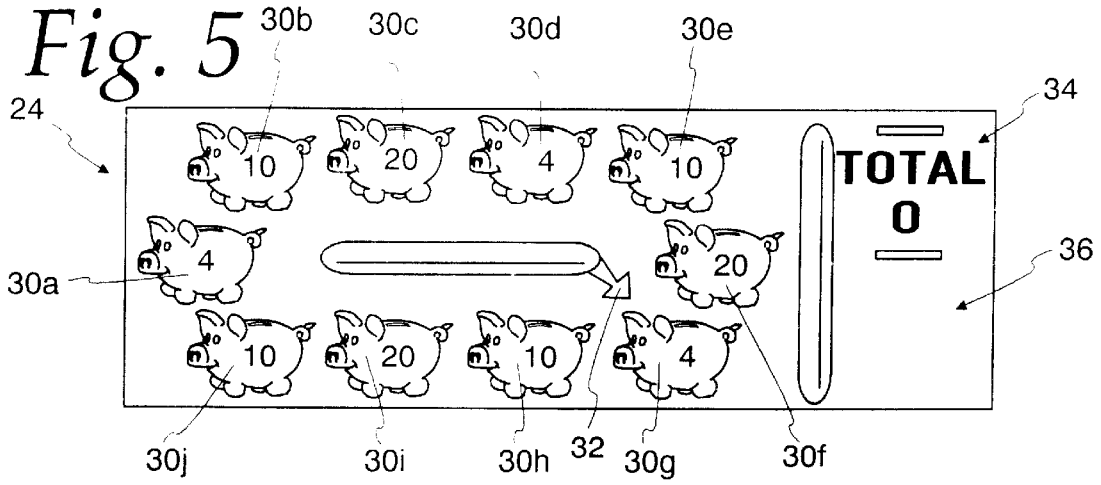
Fig. 6
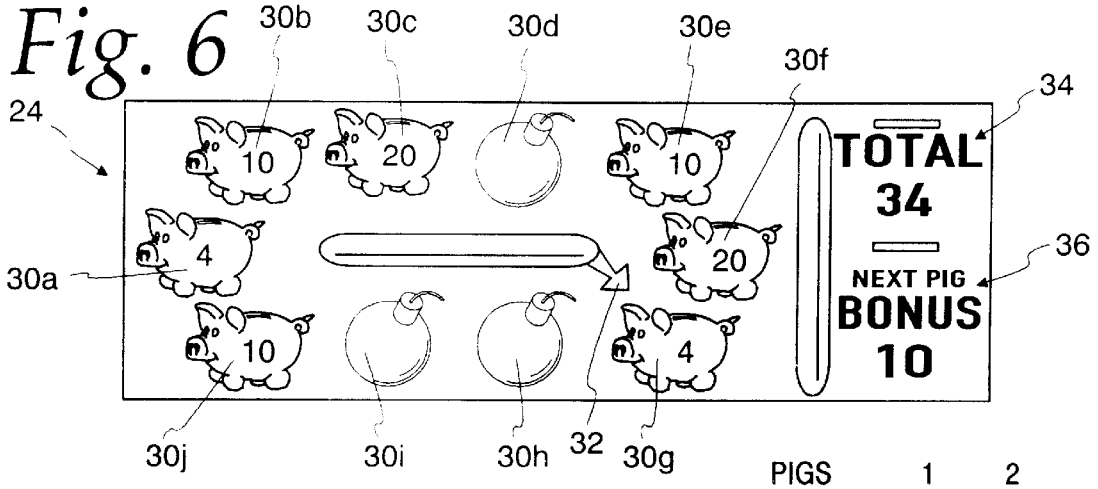
Fig. 8
| PIGS COMPLETED | 1 COIN | 2 COIN |
|---|---|---|
| 1 | — | — |
| 2 | — | — |
| 3 | — | — |
| 4 | — | 10 |
| 5 | 10 | 20 |
| 6 | 20 | 40 |
| 7 | 50 | 100 |
| 8 | 75 | 200 |
| 9 | 200 | 500 |
| 10 | 5000 | 10000 |

| | PIG1 | PIG2 | PIG3 | PIG4 | PIG5 | PIG6 | PIG7 | PIG8 | PIG9 | PIG10 | ave pig value | occurrence |
|---|---|---|---|---|---|---|---|---|---|---|---|---|
| set1 | 25 | 25 | 20 | 15 | 10 | 5 | 2 | 2 | 2 | 2 | 10.8 | 1 |
| set2 | 25 | 25 | 20 | 15 | 5 | 2 | 2 | 2 | 2 | 2 | 10 | 1 |
| set3 | 25 | 20 | 10 | 10 | 10 | 5 | 5 | 2 | 2 | 2 | 9.1 | 1 |
| set4 | 25 | 20 | 10 | 10 | 5 | 5 | 5 | 5 | 2 | 2 | 8.9 | 1 |
| set5 | 20 | 20 | 15 | 10 | 5 | 4 | 5 | 2 | 2 | 2 | 8.6 | 1 |
| set6 | 20 | 15 | 15 | 15 | 5 | 5 | 2 | 2 | 2 | 2 | 8.3 | 1 |
| set7 | 25 | 10 | 10 | 10 | 10 | 5 | 5 | 2 | 2 | 2 | 8.1 | 1 |
| set8 | 15 | 15 | 15 | 10 | 5 | 5 | 5 | 5 | 2 | 2 | 7.9 | 1 |
| set9 | 20 | 10 | 10 | 10 | 10 | 5 | 2 | 2 | 2 | 2 | 7.3 | 2 |
| set10 | 20 | 15 | 10 | 10 | 5 | 2 | 2 | 2 | 2 | 2 | 7 | 2 |
| set11 | 15 | 10 | 10 | 10 | 5 | 5 | 2 | 2 | 2 | 2 | 6.3 | 2 |
| set12 | 15 | 10 | 5 | 5 | 5 | 5 | 5 | 2 | 2 | 2 | 5.6 | 2 |
| set13 | 15 | 10 | 5 | 5 | 5 | 5 | 2 | 2 | 2 | 2 | 5.3 | 1 |
| set14 | 10 | 5 | 5 | 5 | 5 | 5 | 5 | 2 | 2 | 2 | 4.6 | 1 |
| set15 | 15 | 5 | 5 | 2 | 2 | 2 | 2 | 2 | 2 | 2 | 3.9 | 1 |
| set16 | 10 | 5 | 5 | 5 | 2 | 2 | 2 | 2 | 2 | 2 | 3.7 | 1 |
| set17 | 10 | 5 | 5 | 2 | 2 | 2 | 2 | 2 | 2 | 2 | 3.4 | 1 |
| set18 | 10 | 5 | 2 | 2 | 2 | 2 | 2 | 2 | 2 | 2 | 3.1 | 1 |
| set19 | 5 | 5 | 5 | 2 | 2 | 2 | 2 | 2 | 2 | 2 | 2.9 | 1 |
| set20 | 5 | 5 | 2 | 2 | 2 | 2 | 2 | 2 | 2 | 2 | 2.6 | 1 |

FIG. 7

| SPINS | BOMBS | % end | % safe | 1 COIN | 2 COIN | 1 coin bonus | 2 coin bonus | 1 coin EV | 2 coin EV |
|---|---|---|---|---|---|---|---|---|---|
| 1 | 0 | 0 | 1 | 6.4 | 12.8 | | | 6.4 | 12.8 |
| 2 | 1 | 0.1 | 0.9 | 12.8 | 25.6 | | | 12.16 | 24.32 |
| 3 | 2 | 0.18 | 0.72 | 19.2 | 38.4 | | | 16.768 | 33.536 |
| 4 | 3 | 0.216 | 0.504 | 25.6 | 61.2 | | 10 | 19.9936 | 45.0272 |
| 5 | 4 | 0.2016 | 0.3024 | 42 | 94 | 10 | 30 | 24.95296 | 54.94592 |
| 6 | 5 | 0.1512 | 0.1512 | 68.4 | 146.8 | 30 | 70 | 28.94464 | 62.92928 |
| 7 | 6 | 0.09072 | 0.06048 | 124.8 | 259.6 | 80 | 170 | 32.35571 | 69.75142 |
| 8 | 7 | 0.042336 | 0.018144 | 206.2 | 472.4 | 155 | 370 | 33.83263 | 73.61247 |
| 9 | 8 | 0.014515 | 0.003629 | 412.6 | 985.2 | 355 | 870 | 34.58162 | 75.47332 |
| 10 | 9 | 0.003266 | 0.000363 | 5419 | 10998 | 5355 | 10870 | 36.39834 | 79.10676 |
| | | | | | | | | 36.39834 | 79.10676 |

FIG. 9

| Combination | 1 Coin Pay | 2 Coin Pay | Hits | Pulls/Hit | Prob. | EV | Max. EV |
|---|---|---|---|---|---|---|---|
| 1 Wild | 1 | 2 | 433 | 31.9261 | 0.031322 | 0.0313223 | 0.031322 |
| 1 Cherry | 2 | 4 | 552 | 25.04348 | 0.039931 | 0.0798611 | 0.079861 |
| Wild Cherry | 5 | 10 | 24 | 576 | 0.001736 | 0.0086806 | 0.008681 |
| Any Bars | 5 | 10 | 750 | 18.432 | 0.054253 | 0.2712674 | 0.271267 |
| 1 Bars | 10 | 20 | 90 | 153.6 | 0.00651 | 0.0651042 | 0.065104 |
| 2 Bars | 20 | 40 | 9 | 384 | 0.002604 | 0.0520833 | 0.052083 |
| 3 Bars | 40 | 80 | 2 | 6912 | 0.000145 | 0.005787 | 0.005787 |
| Any 7s | 50 | 100 | 3 | 2764.8 | 0.000362 | 0.0180845 | 0.018084 |
| 7 Bars | 70 | 140 | 2 | 6912 | 0.000145 | 0.0101273 | 0.010127 |
| 7 Wild 7 | 400 | 1000 | 1 | 13824 | 7.23E-05 | 0.0289352 | 0.036169 |
| | | | | | | | |
| Pigs | 36.39834 | 79.10676 | 100 | 138.24 | 0.007234 | 0.2632982 | 0.286121 |
| Break Bank | 10 | 24.06 | 64 | 216 | 0.00463 | 0.0462963 | 0.0557 |
| | | | | | | | |
| **TOTALS** | | | **Hits** | **Pulls/Hit** | **Hit Rate** | **Coin1 %** | **Coin2 %** |
| | | | 2059 | 6.713939 | 0.148944 | 0.8808474 | 0.920308 |
| | | | | | | | |

FIG. 10

DUAL-AWARD BONUS GAME FOR A GAMING MACHINE

FIELD OF THE INVENTION

The present invention relates generally to gaming machines and, more particularly, to a bonus game for a gaming machine.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available, because such machines attract frequent play and hence increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

One concept which has been successfully employed to enhance the entertainment value of a game is the concept of a "secondary" or "bonus" game which may be played in conjunction with a "basic" game. The bonus game may comprise any type of game, either similar to or completely different from the basic game, which is entered upon the occurrence of a selected event or outcome of the basic game. The bonus game concept is the subject of U.S. patent application Ser. No. 08/835,840 [hereinafter "the '840 application"], filed Apr. 23, 1997, assigned to the assignee of the present invention and incorporated herein by reference. The '840 application discloses an embodiment wherein the basic game is a reel-type slot machine and the bonus game is a simulated reel-type slot machine implemented on a dot-matrix display. The bonus game is entered upon the appearance of a special symbol combination on the reels of the slot machine in the basic game. Generally, the expectation of winning coins or credits in the bonus game is much greater than that of the basic game. The player is permitted to keep playing and accumulating winnings from the bonus game until a losing trial occurs. Such a bonus game produces a significantly higher level of player excitement than the basic game because it provides a greater expectation of winning than the basic game and is accompanied with more attractive or unusual video displays and/or audio.

Because the bonus game concept offers tremendous advantages in player appeal and excitement relative to other known games, and because such games are attractive to both players and operators, there is a continuing need to develop new types of bonus games to satisfy the demands of players and operators. Preferably, such new bonus games will maintain, or even further enhance, the level of player excitement offered by bonus games heretofore known in the art. The present invention is directed to satisfying these needs.

SUMMARY OF THE INVENTION

In accordance with one aspect of the present invention, there is provided a dual award bonus game for a gaming machine operable in a bonus mode under control of a processor. The bonus game consists of the selection of various selection elements, one at a time, under player or processor control from a plurality of selection elements having bonus game outcomes assigned thereto. A number of the selection elements have values assigned thereto and a number of the selection elements have end-bonus penalties assigned thereto by the processor. The selection of a selection element not associated with an end-bonus penalty defines a successful trial causing the processor to continue the bonus game, whereas the selection of a selection element associated with an end-bonus penalty causes the processor to end the bonus game. The processor determines a value of the selection elements selected in the bonus game and awards a credit based on that value. The processor also determines the number of successful trials accomplished in the bonus game and awards a credit based on that number.

BRIEF DESCRIPTION OF THE DRAWINGS

The foregoing and other advantages of the invention will become apparent upon reading the following detailed description and upon reference to the drawings in which:

FIG. 5 is a display of a bonus game played on the slot machine of FIG. 1 in one embodiment of the present invention as it may appear upon setup of the bonus game;

FIG. 6 is a display of a bonus game played on the slot machine of FIG. 1 in one embodiment of the present invention as it may appear after three trials of the bonus game;

FIG. 7 is a table showing various selection values which might be used in a bonus game of the type shown in FIG. 5 and FIG. 6;

FIG. 8 is a pay table showing various quantity-based bonus awards which might be used in a bonus game of the type shown in FIG. 5 and FIG. 6;

FIG. 9 is a table summarizing various possible outcomes of a bonus game of the type shown in FIG. 5 and FIG. 6; and FIG. 10 is a math table summarizing various probabilities and expected values of the outcomes which may occur in either the basic game or bonus game played on the slot machine of FIG. 1 in one embodiment of the present invention.

Figure 1A:
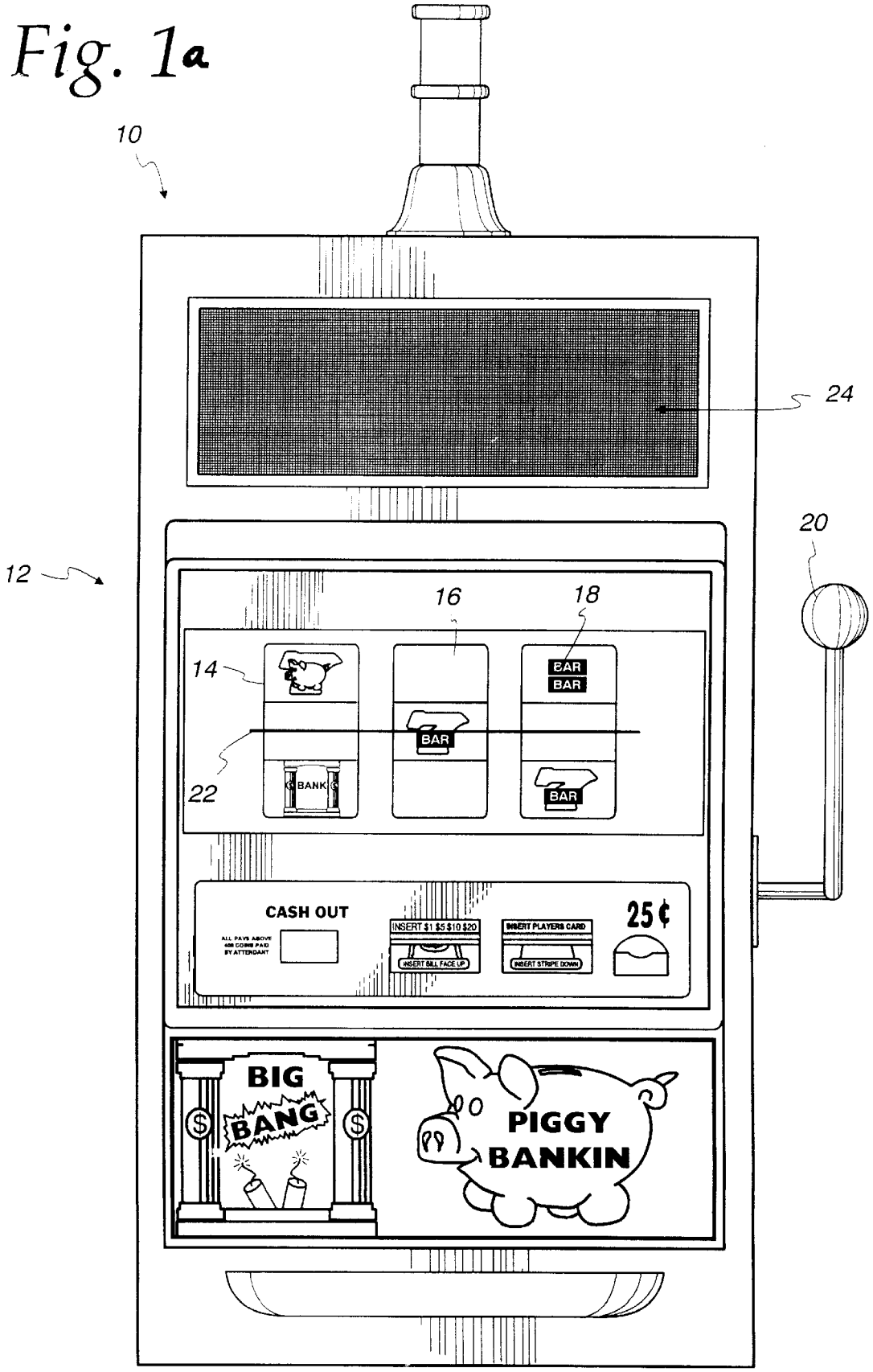
FIG. 1*a* is a simplified illustration of a spinning reel slot machine with dot matrix display on which the present invention may be implemented.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1*a*, there is shown a slot machine 10 on which the present invention may be implemented. The slot machine 10 is operable in a basic mode to play a "basic" slot machine game and in a bonus mode to play a "bonus" or secondary game. The slot machine 10 includes a display window 12 through which a player may observe three spinning reels, 14, 16 and 18. The slot machine further includes a video display 24 for displaying various graphics associated with the basic game and/or bonus game. The video display 24 may comprise a dot matrix, CRT, LED, electro-luminescent display or generally any type of video display known in the art. In one embodiment, the basic game is implemented on the reels 14, 16, 18 and video display 24, whereas the bonus game is implemented entirely on the video display 24. It will be appreciated, however, that both the basic game and the bonus game may be implemented entirely in video.

Figure 1B:
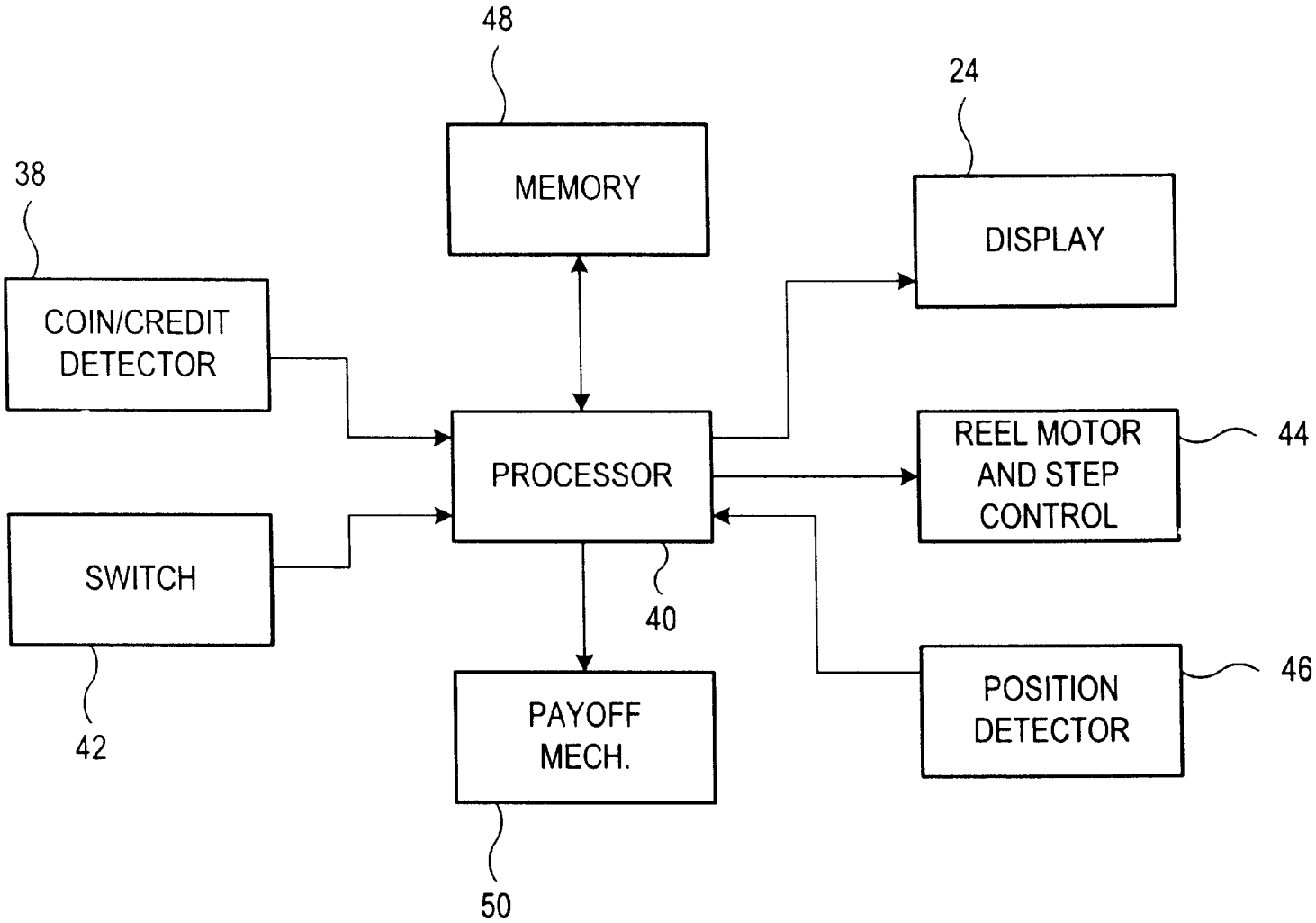
FIG. 1*b* is a block diagram of a control system for the slot machine of FIG. 1*a;*

FIG. 1*b* is a block diagram of a control system suitable for operating the slot machine 10 of FIG. 1*a*. Coin/credit detector 38 signals a processor 40 when a player has inserted a number of coins or played a number of credits. Then, after the player has activated a switch 42 (e.g., by pulling lever 20 or pushing a button), the processor 40 initiates basic game play by setting reels 14, 16, 18 in motion, randomly selecting a stop position of the reels 14, 16, 18 and, using technology well known in the art, causing a reel motor and step controller 44 to stop the reels 14, 16, 18 at the selected stop position. A rotational position detector 46 provides feedback to the processor 40 to ensure that the reels 14, 16, 18 are stopped at the correct stop position. The symbols displayed on the reels at the preselected stop position define the basic game outcome.

A system memory 48 stores control software, operational instructions and data associated with the slot machine 10. In one embodiment, the memory 48 comprises a separate read-only memory (ROM) and battery-backed random-access memory (RAM). However, it will be appreciated that the memory 48 may be implemented on any of several alternative types of memory structures or may be implemented on a single memory structure. A payoff mechanism 50 is operable in response to instructions from the processor to award a payoff of coins or credits to the player in response to certain winning combinations stored in memory 48. As will be described in detail hereinafter, the payoff amount of certain combinations is predetermined according to a pay table stored in system memory 48.

As best observed in FIG. 1*a*, the symbols displayed on the reels 14, 16, 18 define a symbol group consisting of nine symbols, with each symbol being displayed in either an upper, center, or lower display position on one of the reels 14, 16, 18. It will be appreciated, however, that any of several alternative symbol group configurations may be employed, for example, where the slot machine 10 has fewer or greater numbers of reels, and/or where fewer or greater numbers of symbols are visible in the display window 12.

In one embodiment, the combination of symbols which determine the basic game outcome consist of only those symbols which are aligned with center payline 22. It will be appreciated, however, that a basic game implemented on the slot machine 10 may use a variety of other payline configurations to define the basic game outcome. For example, the slot machine 10 might include an upper payline (where the combination of symbols consisting of the upper symbol on each reel comprises the game outcome), lower payline (where the combination of symbols consisting of the lower symbol on each reel comprises the game outcome), angled paylines (where the combination of symbols consisting of the lower, center and upper symbols, respectively, or upper, center and lower symbols, respectively, on the three reels comprises the game outcome) or diamond-shaped paylines (where the combination of symbols consisting of the center symbol on the first and third reels and either the upper or lower symbol on the second reel comprises the game outcome).

Alternatively or additionally, another payline configuration known as a scatter-pay configuration may be employed to define the basic game outcomes. In the scatter-pay configuration, symbol combinations defining the game outcomes are not required to be aligned with fixed payline(s). Rather, the symbol group is determined to include a basic winning combination if any combination of three symbols consisting of one symbol from each of the three reels 14, 16, 18 corresponds to one of the symbol combinations identified in the pay table. Thus, for example, suppose the symbol combination SYMBOL1, SYMBOL2, SYMBOL3 is a basic winning combination of a game played on the slot machine 10. In scatter-pay format, the winning combination occurs if reel 14 displays SYMBOL1 in either of the upper, center or lower display positions, reel 16 displays SYMBOL2 in either of the upper, center or lower display positions (which need not correspond to the display position of SYMBOL1 on reel 14) and reel 18 similarly displays SYMBOL3 in either of the upper, center or lower display positions (which need not correspond to the display positions of SYMBOL1 or SYMBOL2 on reel 14 or 16).

In one embodiment, the symbol group displayed on reels 14, 16, 18 may indicate any of five possible basic game outcomes, including (1) a traditional winning outcome causing the processor 40 to award the player a predetermined amount of coin(s) or credit(s); (2) a progressive winning outcome causing the processor 40 to award the player the current value of a basic game progressive jackpot; (3) a deferred winning outcome causing the processor 40 to increment the value of the basic game progressive jackpot; (4) a start-bonus outcome causing the processor 40 to trigger play of a bonus game displayed on display 24; and (5) a losing outcome causing the processor 40 to continue operation in the basic mode without awarding any coin(s) or credit(s) and without incrementing the value of a progressive jackpot.

The first four types of outcomes may be considered to be winning outcomes inasmuch as they result, either directly or indirectly, in some form of award to the player. Generally, each winning outcome is characterized by the display of one or more predefined combinations of symbols. The symbols defining the winning combinations are stored in the system memory 48. In one embodiment, the symbols defining traditional winning combinations are shown in a pay table affixed to the slot machine 10 so that players may view the winning combinations and associated payoff amounts. In one embodiment, the symbols defining non-conventional winning combinations (i.e., those symbols associated with winning outcomes (2), (3) and (4) above) are also affixed to the slot machine so that players are made aware of the non-conventional winning combinations and their likely or possible effects.

Figure 2:
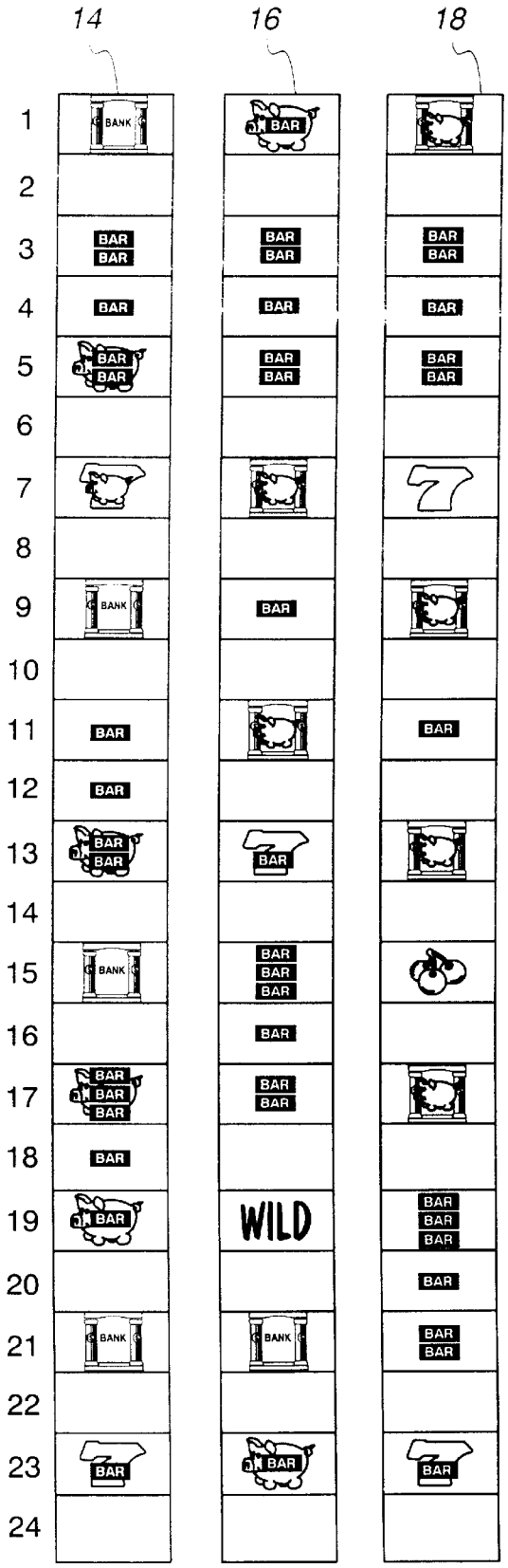
FIG. 2 is an illustration of three reel strips which may be placed on the reels of he slot machine of FIG. 1 to implement the present invention.

FIG. 2 shows a set of reel strips for use with a slot machine of the type shown in FIG. 1 to implement a BIG BANG PIGGY BANKIN'™ slot machine game, assigned to the assignee of the present invention. The reel strips correspond to the reels 14, 16, 18 in FIG. 1 and will be identified by corresponding reference numerals 14, 16, 18. Each of the reel strips 14, 16, 18 include twenty-four symbols (including blanks) corresponding to twenty-four available reel stopping positions. The symbols include WILD, SEVEN, 7-BAR, 3-BAR, 2-BAR, 1-BAR, CHERRY, BREAK THE BANK and "Blank" defining "regular" symbols. Also shown on the reel strips 14,16,18 are small PIG symbols which are displayed on top of (and thereby share the same reel stopping position as) some of the regular symbols.

Specifically, the symbols which appear on reel strip 14 include, in sequence BREAK THE BANK, Blank, 2-BAR, 1-BAR, 2-BAR/PIG, Blank, SEVEN/PIG, Blank, BREAK THE BANK, Blank, 1-BAR, 1-BAR, 2-BAR/PIG, Blank, BREAK THE BANK, Blank, 2-BAR/PIG, 1-BAR, 1-BAR/PIG, Blank, BREAK THE BANK, Blank, 7-BAR and Blank. The symbols which appear on reel strip 16 include, in sequence, 1-BAR/PIG, Blank, 2-BAR, 1-BAR, 2-BAR, Blank, BREAK THE BANK/PIG, Blank, 1-BAR, Blank, BREAK THE BANK/PIG, Blank, 7-BAR, Blank, 2-BAR, 1-BAR, 2-BAR, Blank, WILD, Blank, BREAK THE BANK, Blank, 1-BAR/PIG and Blank. Finally, the symbols which appear on reel strip 18 include, in sequence, BREAK THE BANK/PIG, Blank, 2-BAR, 1-BAR, 2-BAR, Blank, SEVEN, Blank, BREAK THE BANK/PIG, Blank, 1-BAR, Blank, BREAK THE BANK/PIG, Blank, CHERRY, Blank, BREAK THE BANK/PIG, Blank, 3-BAR, 1-BAR, 2-BAR, Blank, 7-BAR and Blank.

Figures 3, 4:
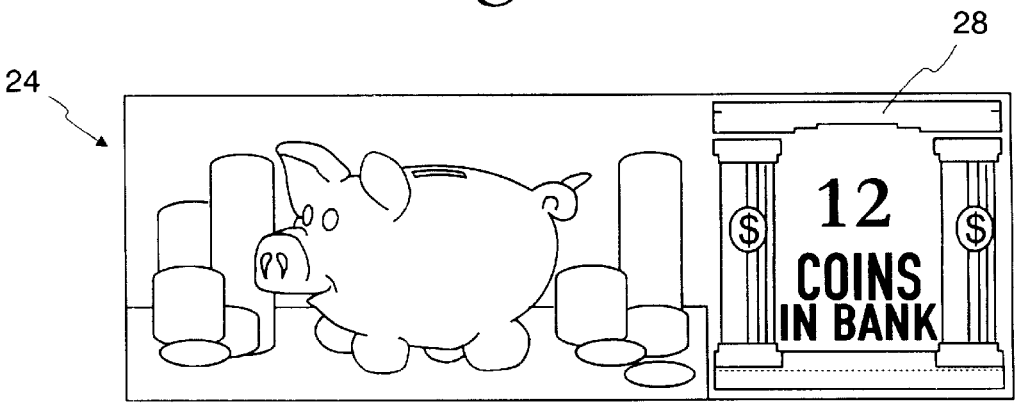
FIG. 3 is a pay table summarizing various winning combinations and payoffs which may occur in a basic game played on the slot machine of FIG. 1 using the reel strips of FIG. 2 according to one embodiment of the present invention.
FIG. 4 is a display of a bank feature which may appear in the basic game played on the slot machine of FIG. 1 in one embodiment of the present invention.

Predefined "traditional" winning combinations associated with one embodiment of the BIG BANG PIGGY BANKIN'™ game are shown in the pay table of FIG. 3. Upon any of the "traditional" winning combinations being displayed in alignment with payline 22, the player is credited a predefined amount corresponding to the particular combination and to the number of coins played. Specifically, in order of ascending value, FIG. 3 identifies the following winning combinations and payoffs: "Blank, WILD, Blank" will award of 1 coin or credit in a 1-coin game and 2 coins or credits in a 2-coin game; "Blank, Blank, CHERRY" will award of 2 coins or credits in a 1-coin game and 4 coins or credits in a 2-coin game; "Blank, WILD, CHERRY" will award of 5 coins or credits in a 1-coin game and 10 coins or credits in a 2-coin game; "Any BAR, Any BAR, Any BAR" will award 5 coins or credits in a 1-coin game and 10 coins or credits in a 2-coin game; "1-BAR, 1-BAR, 1-BAR" will award of 10 coins or credits in a 1-coin game and 20 coins or credits in a 2- coin game; "2-BAR, 2-BAR, 2-BAR" will award 20 coins or credits in a 1-coin game and 40 coins or credits in a 2-coin game; "2-BAR, 2-BAR, 2-BAR" will award 40 coins or credits in a 1-coin game and 80 coins or credits in a 2-coin game; "Any SEVEN, Any SEVEN, Any SEVEN" will award of 50 coins or credits in a 1-coin game and 100 coins or credits in a 2-coin game; "7-BAR, 7-BAR, 7-BAR" will award of 70 coins or credits in a 1-coin game and 140 coins or credits in a 2-coin game; and "SEVEN, WILD, SEVEN" will award of 400 coins or credits in a 1-coin game and 1000 coins or credits in a 2-coin game.

Symbol combinations defining other winning outcomes in one embodiment of the BIG BANG PIGGY BANKIN'™ game include the following: (a) three "Blank" symbols in alignment with payline 22 in a 2-coin game (ie., when playing at MAX BET) will increase the value of the progressive jackpot by one coin or credit (the progressive jackpot is represented by the "Bank" 28 shown on the display 24 (see FIG. 4); (b) three "BREAK THE BANK" symbols in alignment with payline 22 will "break the bank," causing the processor 40 to award the player the amount of coins or credits currently displayed in the bank (e.g., 12 coins or credits in the example shown in FIG. 4); and (c) three "PIG" symbols in alignment with payline 22 will cause the processor 40 to trigger play of a bonus game shown on display 24.

In one embodiment, the value of the progressive jackpot represented by the Bank 28 in FIG. 4 always comprises a non-zero value. This is accomplished by the processor 40 giving the bank 28 an initial non-zero "seed" value upon initial play of the game, or after the bank 28 has been "broken." In one embodiment, the processor 40 randomly selects the bank seed value from a set of twenty individual seed values stored in system memory 48, each of which has a one-in-twenty chance to be selected. The individual seed values are: 5 (6 occurrences), 10 (9 occurrences), 15 (4 occurrences) and 20 (1 occurrence). The probability of selecting a particular seed value is determined by dividing the number of occurrences of that seed value in the set by the total number of seed values in the set. Therefore, with a set of seed values as defined above, the probability of selecting a "5" seed value is 30% (six divided by twenty), the probability of selecting a "10" seed value is 45% (nine divided by twenty), the probability of selecting a "15" seed value is 20% (four divided by twenty) and the probability of selecting a "20" seed value is 5% (one divided by twenty). The average bank seed value is 10.0.

The bank value at any particular time will be the sum of the initial seed value and any incremental values added by non-conventional winning outcome (a) identified above. In one embodiment, incremental values are added only in a 2-coin game (ie., at MAX BET) when three "Blank" symbols are displayed in alignment with payline 22 in a 2-coin game. Because incremental values are not added to the initial seed value in a 1-coin game, the average seed value (i.e., 10.0) becomes the average bank value in a 1-coin game. In a 2-coin game, where incremental values of 1 coin are added upon the occurrence of three "Blank" symbols, a determination of the average bank value must consider the average number of times that incremental values will be added before the bank is "broken" causing the bank value to be reset with another seed value.

In the reel strips of FIG. 2, there are nine "Blank" symbols on reel 14, ten "Blank" symbols on reel 16 and ten "Blank" symbols on reel 18. Thus, there are 900 possible symbol combinations (i.e., 9×10×10) of three "Blank" symbols that will result in the payment of an incremental value to the bank. With 24 symbols on each reel, there are 13,824 total possible reel combinations (i.e., 24×24×24). A combination of three "Blank" symbols, and payment of incremental value to the bank, will therefore occur, on average, once every 15.36 spins (i.e. 13,824÷900). The number of times the bank is "broken," on average is computed in similar fashion. There are four "BREAK THE BANK" symbols on reel 14, three "BREAK THE BANK" symbols (plus one "WILD" symbol which may be used to complete a "BREAK THE BANK" combination) on reel 16 and four "BREAK THE BANK" symbols on reel 18. Thus, there are 64 possible symbol combinations (i.e., 4×4×4) that will "break" the bank. These "BREAK THE BANK" combinations will occur, on average, once every 216 spins (i.e. 13,824÷64). For every time a "BREAK THE BANK" combination occurs, there will have been, on average, 14.06 (i.e., 216 ÷15.36) incremental payments of one coin and therefore the average bank value for a 2-coin game becomes 24.06 (ie., 10+14.06). It will be appreciated, however, that the bank seed values and/or incremental values may be modified to effect different payout amounts and/or percentages.

Now turning to FIG. 5, there is shown the display screen 24 as it may appear upon set up of the BIG BANG PIGGY BANKIN'™ bonus game. The processor 40 sets up the bonus game by displaying a plurality of selection elements, each of which has a bonus game outcome assigned thereto. In the illustrated embodiment, there are ten selection elements 30*a*, 30*b* . . . 30*j* each initially represented as pig graphics on the display 24 and having an initial value displayed thereon. Selection element 30*a* has an initial value of 4 coins or credits, selection element 30*b* has an initial value of 10 coins or credits, and so on.

From the display screen shown in FIG. 5, bonus game play is initiated by the player pulling the lever 20 (FIG. 1) or pressing a SPIN button. The processor 40 then operates according to its game program (stored in system memory 48, FIG. 1*b*) to randomly select one of the ten selection elements 30*a*, 30*b* . . . 30*j*, each of which has a one-in-ten chance of being selected. The selection of the selection element is depicted graphically on the display 24 by an arrow pointer 32 which spins around the ten selection elements 30*a*, 30*b* . . . 30*j*, then slows to a stop at a position which points toward the selected selection element. If the arrow pointer points to a selection element represented by a pig, that selection defines a successful trial of the bonus game and the player is credited the value assigned to that pig. Thus, for example, in the embodiment shown in FIG. 5, with each of the selection elements 30*a*, 30*b* . . . 30*j* initially represented by a pig, the arrow pointer 32 is guaranteed to point to one of the ten pigs and consequently the first trial is guaranteed to be a successful trial.

In one embodiment, after a successful trial, the processor 40 operates according to its game program to redefine the outcome associated with the most recently selected selection element. This is accomplished in one embodiment by changing the pig symbol(s) associated with the selection element in each successful trial to a bomb symbol representing an end-bonus penalty, assigning a zero value to the bomb symbol and then repeating the process with the processor 40 selecting another selection element 30*a*, 30*b* . . . 3*j*. In each successive trial, if the arrow pointer points to a selection element represented by a pig, that selection defines another successful trial of the bonus game, the player is credited the value assigned to that pig, the pig symbol is changed to a bomb symbol and the bonus game continues with another selection. In any trial, however, if the arrow pointer points to a selection element which is represented by a bomb symbol, that selection defines an unsuccessful trial and the bonus game is ended.

FIG. 6 shows the display 24 as it may appear after three successful trials in the BIG BANG PIGGY BANKIN'™ bonus game. Selection elements 30*d*, 30*h* and 30*i*, initially represented as pigs (see FIG. 5), have been transformed from a pig symbol to a bomb symbol, thus indicating that selection elements 30*d*, 30*h* and 30*i* were selected in the first three trials. In the fourth trial, selection of either selection element 30*d*, 30*h* or 30*i* will end the bonus game; otherwise, selection of selection element 30*a*, 30*b*, 30*c*, 30*e*, 30*f*, 30*g* or 30*j* will continue the bonus game as heretofore described.

Upon each successful trial, the processor 40 identifies the value assigned to the selected pig and adds that value to the value of pigs selected in previous trials, if any, to compute a sum of pig values defining a selection-based award. The processor 40 further identifies the number of successful trials that have been accomplished in the bonus game and awards bonus credits based on the number of successful trials, thereby defining a quantity-based award.

In one embodiment, the values assigned to the various "pigs" are selected by the processor 40 from a weighted table consisting of several predefined sets of pig values stored in system memory 48. One such table is shown at FIG. 7, which includes 20 sets of pig values, set1, set2, set3 . . . set20. Each set includes ten pig values, PIG1, PIG2, PIG3 . . . PIG10 defining the values of the ten selection elements in a 1-coin game. The pig values are doubled for a 2-coin game. The average pig value for a 1-coin game ranges between a minimum average value of 2.6 (set 20) and a maximum average value of 10.8 (set1). In a 2-coin game, therefore, the average pig value ranges between a minimum average value of 5.2 (set 20) and a maximum average value of 21.6 (set1).

As may be observed in FIG. 7, the table is weighted by increasing the occurrences of certain sets (e.g., set9,set10, set11 and set12) relative to the other sets. In the table of FIG. 7, the non-weighted sets each have a one-in-twenty-four chance of selection and the weighted sets each have a two-in-twenty-four chance of selection. Using the values of FIG. 7, the average pig value for the entire bonus game is computed by summing the average pig values in each set times the number of occurrences of each set, then dividing that sum by twenty-four. In a 1-coin game, the average pig value is therefore 6.4 (i.e., [10.8+10+9.1+8.9+8.6+8.3+8.1+7.9+(7.3×2)+(7×2)+(6.3×2)+(5.6×2)+5.3+4.6+3.9+3.7+3.4+3.1+2.9+2.6]+24). For a 2-coin game, with pig values doubled, the average pig value is 12.8, twice the average pig value in a 1-coin game. It will be appreciated, however, that any of several alternative sets of pig values and/or weighting systems may be employed in the present invention to effect different average pig values.

In one embodiment of the BIG BANG PIGGY BANKIN'™ game, a successful trial of the bonus game (e.g., the selection of a pig, rather than a bomb) is termed a "pig completed." The processor 40 identifies the number of successful trials (e.g., "pigs completed") and awards bonus credits according to a "PIGS COMPLETED" pay table such as shown in FIG. 8, which is stored in system memory 48. shown in FIG. 8. In one embodiment, as shown in FIG. 8, the completion of 5 or more pigs (in a 1-coin game) or 4 or more pigs (in a 2-coin game) will result in a quantity-based bonus credit. Specifically, in a 1-coin game, 5 pigs completed results in a bonus credit of 10 coins, 6 pigs completed results in a bonus credit of 20 coins, 7 pigs completed results in a bonus credit of 50 coins, 8 pigs completed results in a bonus credit of 75 coins, 9 pigs completed results in a bonus credit of 200 coins and 10 pigs completed results in a bonus credit of 5,000 coins. In a 2-coin game, 4 pigs completed results in a bonus credit of 10 coins, 5 pigs completed results in a bonus credit of 20 coins, 6 pigs completed results in a bonus credit of 40 coins, 7 pigs completed results in a bonus credit of 100 coins, 8 pigs completed results in a bonus credit of 200 coins, 9 pigs completed results in a bonus credit of 500 coins and 10 pigs completed results in a bonus credit of 10,000 coins.

The processor 40 computes the cumulative sum of the pig values (i.e., the selection-based credits) and the pigs completed credits (i.e., the quantity-based credits) and displays the cumulative value in the "TOTAL" field 34 of the display screen 24 (see FIGS. 5 and 6). Thus, for example, in FIG. 5, before any selection has been made, the "TOTAL" field 34 indicates a cumulative value of zero. In FIG. 6, after three successful trials have occurred, the "TOTAL" field 34 indicates a cumulative value of 34 (e.g., 4+20+10, the sum of the selection-based credits associated with selected selection elements 30*d*, 30*i* and 30*h*). In FIG. 6, there is no contribution to cumulative value from quantity-based credits because only three pigs have thus far been completed and, as can be seen in FIG. 8, quantity-based credits are not awarded until at least four or five pigs have been completed, depending on the number of coins played.

If a player is eligible for a bonus credit in the next trial, the amount of the bonus credit is indicated in the "NEXT PIG BONUS" field 36 of the display screen 24. In FIG. 5, for example, there is nothing displayed in the "NEXT PIG BONUS" field 36 because the player is not eligible for a bonus credit on the first selection. In FIG. 6, however, the player is eligible for a bonus credit of 10 (with two coins played) if the fourth selection is a successful trial, and such bonus credit amount is appropriately identified in the "NEXT PIG BONUS" field 36 in FIG. 6.

Upon completion of the bonus game, the processor 40 awards the player an amount of coins or credits based on the cumulative sum of the pig values and bonus credits, as displayed in the "TOTAL" field 34 of the display screen 24. Thus, for example, in FIG. 6, if the next (i.e., fourth) trial of the bonus game results in the selection of selection element 30*d*, 30*h* or 30*i*, the bonus game is ended and the player is awarded 34 coins or credits.

A summary of various possible outcomes of the BIG BANG PIGGY BANKIN'™ game is shown at FIG. 9. The "SPINS" column identifies the various spin numbers (e.g., trial numbers) which may be attempted in the bonus game. With ten selection elements, the maximum number of trials that may be attempted in the bonus game is 10. The entries in the "SPINS" column are thus numbered consecutively from 1 to 10, with SPIN 1 corresponding to the first trial of the bonus game, SPIN 2 corresponding to the second trial of the bonus game and so on until reaching SPIN 10, which corresponds to the tenth trial of the bonus game. The "BOMBS" column identifies the number(s) of end-bonus outcomes (e.g., "bombs") in each respective spin. In a game where the selection elements each initially are represented by pigs and then transformed to bombs after each successful trial, the number of "bombs" increases from zero at SPIN 1 to a maximum of nine at SPIN 10.

The "% end" column in FIG. 9 indicates the probability of each individual spin landing on a bomb, thus ending the game, whereas the "% safe" column indicates the probability of each individual spin landing on a pig (e.g., a "safe" stop), thereby allowing the game to continue with another trial. The "% end" value for any particular spin is computed by multiplying the probability of reaching that spin (e.g., the "% safe" value of the last spin) by the probability that that particular spin, once reached, will land on a bomb (e.g., the number of bombs divided by the number of selection elements). The "% safe" value for any particular spin is computed by subtracting the probability of landing on a bomb in that spin (e.g., the "% end" value of that spin) from the probability of reaching that spin (e.g., the "% safe" value of the last spin).

In the first trial (SPIN 1), there are not yet any bombs assigned to the selection elements and therefore the player is guaranteed to land on a pig and continue with another trial. The "% end" value for SPIN 1 is therefore 0 and the "% safe" value for SPIN 1 is is 1.0. In the second trial (SPIN 2), the selection elements have been redefined to include one bomb. The "% end" value for SPIN 2 is 0.1, which is computed by multiplying the "% safe" value of SPIN 1 (i.e., 1.0) by the probability that SPIN 2, once reached, will land on a bomb (i.e., 0.1). The "% safe" value for SPIN 2 is 0.9, which is computed by subtracting the "% end" value of SPIN 2 (i.e., 0.1) from the "% safe" value of SPIN 1 (i.e., 1.0). In the third trial (SPIN 3), there are now two bombs among the ten selection elements. The "% end" value for SPIN 3 is 0.18, which is computed by multiplying the "% safe" value of SPIN 2 (i.e., 0.9) by the probability that SPIN 3, once reached, will land on a bomb (i.e., 0.2). The "% safe" value for SPIN 3 is 0.72, which is computed by subtracting the "% end" value of SPIN 3 (ie., 0.18) from the "% safe" value of SPIN 2 (i.e., 0.9). The "% end" and "% safe" values for each of the remaining trials are computed in similar fashion.

The "1 COIN" and "2 COIN" columns in FIG. 9 define various expected values (i.e., average pay amounts) which may be expected upon reaching each successive trial in a 1-coin and 2-coin game, respectively. The expected values in the "1 COIN" and "2 COIN" columns are not to be confused with the expected value of the entire game, but rather represent expected values for specific numbers of trials. The "1 COIN" and "2 COIN" values are computed by multiplying the number of trials by the average pig value, then adding any bonus credits for completed pigs. Thus, for example, the "1 COIN" value for SPIN 1 is 6.4 (i.e., the average pig value in a 1-coin game, with no bonus credits), the "1 COIN" value for SPIN 2 is 12.8 (i.e., 2×6.4+no bonus credits); the "1 COIN" value for SPIN 3 is 19.2 (i.e., 3×6.4+no bonus credits); the "1 COIN" value for SPIN 4 is 25.6 (i.e., 4×6.4+no bonus credits) and the "1 COIN" value for SPIN 5 is 42 (i.e., 5×6.4+10 bonus credits). The "1 COIN" values for each of the remaining trials are computed in similar fashion. The "2 COIN" values are computed using an average pig value of 12.8 and a different set of bonus values, but otherwise are computed in similar fashion as the "1 COIN" values.

The "1 coin bonus" and "2 coin bonus" columns in FIG. 9 identify the cumulative bonus credits which may be expected upon reaching each successive trial in a 1-coin and 2-coin game, respectively. Thus, for example, in a 1-coin game, with 10 bonus credits for five pigs completed, 20 bonus credits for 6 pigs completed, 50 bonus credits for 7 pigs completed, and so on, the "1 coin bonus" for SPIN 5 is 10 credits, the "1 coin bonus" for SPIN 6 is 30 credits (i.e., 10+20), the "1 coin bonus" for SPIN 7 is 80 credits (i.e., 10+20+50) and so on.

The "1 coin EV" and "2 coin EV" columns in FIG. 9 identify various intermediate values associated with each successive trial which leads to computation of an overall expected value for a 1-coin game and 2-coin bonus game, respectively. The various intermediate EV values for a 1-coin game are computed by the formula EV=(%SAFE)×(1 COIN−Previous 1 COIN)+previous 1 coin EV. Similarly, the various intermediate EV values for a 2-coin game are computed by the formula EV=(%SAFE)×(2 COIN−Previous 2 COIN)+previous 2 coin EV. Thus, for example, the 1 coin EV value for SPIN 1 is 1.0×(6.4−0)+0=6.4, the 1 coin EV value for SPIN 2 is 0.9×(12.8−6.4)+6.4=12.16, the 1 coin EV value for SPIN 3 is 0.72×(19.2−12.8)+12.16=16.768, and so on. The 1-coin EV value for SPIN 10, which is the overall expected value of a 1-coin bonus game, is 0.000363×(5419−412.6)+34.58162=36.39834. Similarly, the 2 coin EV value for SPIN 1 is 1.0×(12.8−0)+0=12.8, the 2 coin EV value for SPIN 2 is 0.9×(25.6−12.8)+12.8=24.32, the 2 coin EV value for SPIN 3 is 0.72×(38.4−25.6)+24.32=33.536, and so on. The 2-coin EV value for SPIN 10, which is the overall expected value of a 2-coin bonus game, is 0.000363×(10998−985.2)+75.47332=79.10676.

FIG. 10 is a math table summarizing various probabilities and expected values of the outcomes which may occur in the BIG BANG PIGGY BANKIN'™ slot machine game. The "Combination" column identifies the various combinations that may occur in the basic portion of the game. The "1 Coin Pay" and "2 Coin Pay" columns identify the pay amounts associated with the various combinations. In the case of the "Pigs" and "Break the Bank" combinations, the "1 Coin Pay" and "2 Coin Pay" columns identify the average pay amounts which may be expected in the bonus game and in the bank feature, respectively.

The "Hits" column identifies, for each particular combination of symbols, the number of unique symbol combinations that will support that combination. The number of unique combinations supporting a particular outcome (ie., the number of "Hits") is the product of the number of reel positions on each respective reel that will support that outcome. For example, there is only reel position on each of reels 14, 16, 18 that will support the "7, WILD, 7" outcome. The product of the reel positions supporting the "7, WILD, 7" outcome is 1 (i.e., 1×1×1). Thus, the "Hits" value for the "7, WILD, 7" outcome is 1, indicating that there is only one unique combination of symbols that will support the "7, WILD, 7" outcome. As a further example, consider the "7 BARs" outcome. There is one "7 BAR" symbol on reel 14, one "7 BAR" symbol on reel 16 (plus one "WILD" symbol which may be used to complete the "7 BAR" combination) on reel 16 and one "7 BAR" symbol on reel 18. The product of the reel positions supporting the "7 BARs" outcome is 2 (i.e., 1×2×1). Thus, there are 2 possible symbol combinations that will result in a "7 BAR" combination. The remaining "Hit" values are computed in like fashion. The "Total Hits" value (i.e. 2,059) is the sum of the "Hits" values of the various combinations.

The "Pulls/Hit" column of FIG. 10 identifies, on average, the number of pulls that would be required to "hit" each respective symbol combination. Where the reels each have twenty-four reel stop positions, as in the BIG BANG PIGGY BANKIN'™ game, the odds of "hitting" each unique combination relative to a single active payline (e.g., center payline 22) is one in 13,824 (24×24×24). The "Pulls/Hit" value for any particular combination is computed by dividing the number of possible symbol combinations (13,824) by the "Hits" value for that combination. Thus, the "Pulls/Hit" value for the "7, WILD, 7" outcome is 13,824 (i.e., 13,824÷1) and the "Pulls/Hit" value for the "7 BAR" combination is 6,912 (i.e., 13,824÷2). The remaining "Pulls/Hit" values are computed in like fashion. The "Pulls/Hit" value at the bottom of the column represents the number of pulls, on average, that would be required to hit any of the winning combinations. This value is 6.713939 (i.e., 13,824÷2059).

The "Probability" column indicates the various probabilities of hitting the identified combinations in a single spin. This is computed by taking the inverse of the "Pulls/Hit" values. The "Hit Rate" value at the bottom of the column represents the probability of hitting any winning combination in a single spin.

The "EV" column identifies the expected values of the respective identified combinations in a 1-coin game, computed for each outcome by taking the product of the "1 Coin Pay" value and the "Probability" value. The "Max. EV" column identifies the normalized expected values of the respective identified combinations in a 2-coin game, computed for each outcome by taking the product of the "2 Coin Pay" value and the "Probability" value and dividing by two. Thus, for the "7, WILD, 7" outcome, the "EV" value is 0.0289352 (400×7.23E-05) and the "Max EV" value is 0.036169 (1000×7.23E-05÷2). For the "7 BARs" outcome, the "EV" value is 0.0101273 (70×0.000145) and the "Max EV" value is also 0.0101273 (140×0.000145÷2). The remaining "EV" and "Max EV" values are computed in similar fashion.

The "Coin1 %" value at the bottom of the "EV" column represents the payout rate of the 1-coin game and is computed by summing the various expected values of the 1-coin game. With the expected values as shown in FIG. 10, the payout rate for a 1-coin game is 0.8808474 or 88.08%. Similarly, the "Coin2 %" value at the bottom of the "Max EV" column represents the payout rate of the 2-coin game and is computed by summing the various normalized expected values of the 2-coin game. Thus, with the normalized expected values as shown in FIG. 10, the payout rate for a 2-coin game is 0.920308 or 92.03%.

It will be appreciated that the information provided in FIGS. 5–10 is unique to one particular embodiment of the BIG BANG PIGGY BANKIN'™ bonus game but the present invention is neither limited to the BIG BANG PIGGY BANKIN'™ bonus game nor to a particular embodiment of the BIG BANG PIGGY BANKIN'™ game. On the contrary, the bonus game according to the present invention may be implemented with other types of games and/or with other embodiments of the BIG BANG PIGGY BANKIN'™ game which may include, for example, different number(s) of selection elements, different graphical symbols identifying the various selection elements, different values of selection-based awards and/or quantity-based awards, different payback percentages, etc.

The bonus game according to the present invention may also be implemented with different game rules. For example, in one alternative embodiment, end-bonus penalties (e.g, "bombs") might be assigned to one or more selection elements upon set up of the bonus game and those outcomes could remain fixed throughout the bonus game. Non-zero values might also be assigned to the "bomb" outcomes so that selection of a "bomb" outcome, although ending the bonus game, will add to the cumulative total awarded in the bonus game. The game rules might also be set up so that a fixed number of end-bonus penalties (e.g., two or more) may be collected before the bonus game is ended.

Moreover, it will be appreciated that the bonus game according to the present invention may be played as a stand-alone game (i.e., without a "basic" game) or with a basic game other than a slot machine game. In the latter case, all that is required is that the bonus game is triggered upon the occurrence of a special event or outcome in the basic game. Thus, for example, the basic game might comprise a video blackjack game and the bonus game triggered upon a "blackjack" or "21" occurring in the blackjack game. The bonus game selection elements in such case might be depicted as a plurality of playing cards which are transformed into a "Joker" or other suitable end-bonus symbol upon each successful trial.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A method of operating a gaming machine under control of a processor operable in a bonus mode, the method comprising the steps of:

setting up under control of the processor a bonus game by defining a plurality of selection elements;

assigning various bonus game outcomes to the selection elements;

selecting, one at a time, one or more of the selection elements in the bonus mode until encountering a selection element associated with an end-bonus penalty, the selection of a selection element associated with an end-bonus penalty causing the processor to end the bonus game, the selection of a selection element not associated with an end-bonus penalty defining a successful trial of the bonus game;

determining under control of the processor a value of the selection elements selected in the bonus game;

awarding a first credit based on said value of the selection elements selected;

determining under control of the processor a number of successful trials accomplished in the bonus game; and awarding a second credit based on said number of successful trials.

2. The method of claim 1 wherein the gaming machine includes a display, the method of operating the gaming machine comprising the step of displaying symbols associated with the various bonus game outcomes.

3. The method of claim 1 wherein the step of assigning various bonus game outcomes to the selection elements comprises:

assigning upon setup of the bonus game an initial outcome to each selection element; and assigning after each successful trial of the bonus game an end-bonus penalty to the selection element associated with the successful trial.

4. The method of claim 1 wherein the step of assigning various bonus game outcomes to the selection elements comprises:

assigning upon setup of the bonus game a payoff value to each selection element; and assigning after each successful trial of the bonus game an end-bonus penalty to the selection element associated with the successful trial.

5. The method of claim 4 wherein the step of determining the value of the selection elements selected in the bonus game comprises summing the payoff values of the selection elements selected in the bonus game.

6. The method of claim 4 wherein the step of determining the value of the selection elements selected in the bonus game comprises summing the payoff values of the selection elements selected in successful trials of the bonus game.

7. The method of claim 4 wherein the gaming machine includes a display, the method of operating the gaming machine further comprising the steps of:

displaying end-bonus identifier symbols on selection elements associated with an end-bonus penalty; and displaying payoff value identifier symbols on selection elements not associated with an end-bonus penalty.

8. The method of claim 7 further comprising the steps of:

displaying a pointer animation scrolling through one or more of the selection elements during each trial of the bonus game; and stopping the pointer animation adjacent to the selected selection element, a successful trial being characterized by stopping the pointer animation adjacent to a selection element associated with a payoff value identifier symbol, an unsuccessful trial being characterized by stopping the pointer animation adjacent to a selection element associated with an end-bonus identifier symbol.

9. The method of claim 1 wherein the step of selecting the selection elements in the bonus mode is accomplished randomly under control of the processor.

10. The method of claim 9 wherein the step of selecting the selection elements in the bonus mode is accomplished randomly under control of the processor, with each selection element having an equal probability of selection in each trial.

11. The method of claim 1 wherein the step of awarding a second credit based on the number of successful trials comprises:

identifying under control of the processor a predefined bonus amount associated with said number of successful trials; and crediting said predefined bonus amount to a player.

12. A method of operating a gaming machine under control of a processor operable in a basic mode and a bonus mode, the method comprising the steps of:

selecting under control of the processor in said basic mode a basic game outcome from among a plurality of possible basic game outcomes, the possible basic game outcomes including a start-bonus outcome;

shifting operation of the processor from the basic mode to the bonus mode in response to the selection of the start-bonus outcome, otherwise, continuing operation of the processor in the basic mode;

setting up under control of the processor a bonus game by defining a plurality of selection elements;

assigning various bonus game outcomes to the selection elements;

selecting, one at a time, one or more of the selection elements in the bonus mode until encountering a selection element associated with an end-bonus penalty, the selection of a selection element associated with an end-bonus penalty causing the processor to shift operation from the bonus mode to the basic mode, otherwise, the selection of a selection element not associated with an end-bonus penalty defining a successful trial of the bonus game causing the controller to maintain operation in the bonus mode;

determining under control of the processor a value of the selection elements elected in the bonus mode;

awarding a first credit based on said value of the selection elements selected;

determining under control of the processor a number of successful trials accomplished in the bonus game; and awarding a second credit based on said number of successful trials.

13. The method of claim 12 wherein the basic game comprises a slot machine including a number of reels each including a plurality of displayable symbols, the step of selecting a basic game outcome comprising the steps of:

randomly selecting a combination of said symbols; and displaying said combination of symbols.

14. The method of claim 13 wherein the start-bonus outcome is characterized by the display of a designated start-bonus game symbol on each of the reels.

15. A gaming machine comprising:

a processor for controlling game play in a bonus mode, the processor operating in the bonus mode to set up a bonus game by defining a plurality of selection elements;

means for assigning under control of the processor various bonus game outcomes to the selection elements;

means for selecting, one at a time, one or more of the selection elements in the bonus mode until encountering a selection element associated with an end-bonus penalty, the selection of a selection element associated with an end-bonus penalty causing the processor to end the bonus game, the selection of a selection element not associated with an end-bonus penalty defining a successful trial of the bonus game;

valuation means for determining under control of the processor a value of the selection elements selected in the bonus game;

first credit means for awarding a first credit based on said value of the selection elements selected;

enumeration means for determining under control of the processor a number of successful trials accomplished in the bonus game; and second credit means for awarding a second credit based on said number of successful trials.

16. The gaming machine of claim 15 wherein the valuation means includes means for summing the payoff values of the selection elements selected in the bonus game.

17. The gaming machine of claim 15 wherein the valuation means includes means for summing the payoff values of the selection elements selected in successful trials of the bonus game.

18. The gaming machine of claim 15 wherein the second credit means comprises:

means for identifying under control of the processor a predefined bonus amount associated with the number of successful trials; and means for crediting the predefined bonus amount to a player.

19. The gaming machine of claim 15 further comprising a display, the display being operable in response to instructions from the processor to display symbols associated with the various bonus game outcomes.

20. The gaming machine of claim 15 further comprising a display, the display being operable in response to instructions from the processor to display end-bonus identifier symbols on selection elements associated with an end-bonus penalty and payoff value identifier symbols on selection elements not associated with an end-bonus penalty.

21. A gaming machine comprising:

a processor for controlling game play in a basic mode and a bonus mode, the processor operating in the basic mode to select a basic game outcome from among a plurality of possible basic game outcomes, the possible basic game outcomes including a start-bonus outcome the selection of which causes the processor to shift operation from the basic mode to the bonus mode;

the processor operating in the bonus mode to set up a bonus game by defining a plurality of selection elements;

means for assigning under control of the processor various bonus game outcomes to the selection elements;

means for selecting, one at a time, one or more of the selection elements in the bonus mode until encountering a selection element associated with an end-bonus penalty, the selection of a selection element associated with an end-bonus penalty causing the processor to end the bonus game, the selection of a selection element not associated with an end-bonus penalty defining a successful trial of the bonus game;

valuation means for determining under control of the processor a value of the selection elements selected in the bonus game;

first credit means for awarding a first credit based on said value of the selection elements selected;

enumeration means for determining under control of the processor a number of successful trials accomplished in the bonus game; and second credit means for awarding a second credit based on said number of successful trials.

* * * * *